US007353559B1

(12) United States Patent
Blackwell

(10) Patent No.: US 7,353,559 B1
(45) Date of Patent: Apr. 8, 2008

(54) POOL BRUSH WITH ADJUSTABLE DEFLECTOR VANE

(76) Inventor: Gregory A. Blackwell, 1470 N. Pearson La., Roanoke, TX (US) 76262

( * ) Notice: Subject to any disclaimer, the term of this patent is extended or adjusted under 35 U.S.C. 154(b) by 374 days.

(21) Appl. No.: 11/008,017

(22) Filed: Dec. 9, 2004

Related U.S. Application Data

(60) Provisional application No. 60/528,282, filed on Dec. 9, 2003.

(51) Int. Cl.
*E04H 4/16* (2006.01)

(52) U.S. Cl. ..... 15/1.7

(58) Field of Classification Search ..... 15/1.7; 114/222

See application file for complete search history.

(56) References Cited

U.S. PATENT DOCUMENTS 2,243,576 A 5/1941 Otto
3,003,168 A 10/1961 Shouldice
4,733,427 A 3/1988 Conrad
4,783,868 A 11/1988 O'Callaghan
4,909,173 A 3/1990 Strong
4,962,558 A * 10/1990 Harrell, Jr. ..... 15/1.7
5,864,917 A 2/1999 Landsman
2003/0102009 A1* 6/2003 Fortier ..... 134/6

FOREIGN PATENT DOCUMENTS

WO 01/71125 * 9/2001

* cited by examiner

*Primary Examiner*—Mark Spisich
(74) *Attorney, Agent, or Firm*—Mark W. Handley

(57) ABSTRACT

A cleaning tool (12) includes cleaning utensil (18), a handle (14) and a deflector vane (30). The deflector vane (30) is pivotally attached to the cleaning utensil (18), and defines a deflector surface (40) having a peripheral edge (46) which is shaped to define two side lobes (48) and a notch (52) in a central portion thereof. The deflector surface (40) has an edge profile (44) which is of an arcuate shape. Two ribs (54) extend in parallel from a side (42) of the deflector vane (30) which is opposite the deflector surface (40). A brace (34) is removably secured in different positions relative to the two ribs (54) for determining an angle between the handle (14) and the deflector vane (30) during downstrokes, to control a level of force which presses the utensil (18) against a surface being cleaned.

13 Claims, 5 Drawing Sheets

POOL BRUSH WITH ADJUSTABLE DEFLECTOR VANE

TECHNICAL FIELD OF THE INVENTION

The present invention relates in general to cleaning equipment, and in particular to a brush for cleaning submerged surfaces having a deflector for pressing the brush against a submerged surface being cleaned.

CROSS-REFERENCE TO RELATED APPLICATION

The present application is related to U.S. Provisional Patent Application No. 60/528,282, and filed Dec. 9, 2003, and invented by Gregory A. Blackwell.

BACKGROUND OF THE INVENTION

Prior art brushes for cleaning submerged surfaces have been provided. Some prior devices have flat plates which are mounted to the tops of brushes and secured to handles for the brush. The flat plates deflect water as the brushes are moved through water to push the brushes into the submerged surfaces being cleaned. Some prior art brushes have been provided for marine use, that is, for cleaning submerged surfaces such as boat hulls. The marine type prior art brushes typically have plates mounted to the brushes which pivot when the brushes are pulled upward and downward to push the brushes against surfaces being cleaned on both up strokes and down strokes. Other prior art brushes have been designed for cleaning pools. For cleaning pools, is it preferable to only push debris downward toward the drain in the bottom of the pools, and to not drag the debris back up the sidewalls of the pool. Pool type prior art brushes have plates which pivot from first positions during downstrokes to second positions during up strokes. In the first positions, movement of the plates through water pushes the brushes against surfaces of the pools being cleaned. In the second positions, the plates pivot such that the plates do not push the brushes against the pool surfaces as the brush is pulled upwards, so that debris being cleaned from the pools will not be dragged back up the walls of the pools.

SUMMARY OF THE INVENTION

A cleaning tool is provided by a cleaning utensil assembly and a handle which is removably secured to the cleaning utensil assembly. The cleaning utensil assembly includes a cleaning utensil, such as a pool brush, a mounting post for attaching the handle, and a deflector vane which is pivotally attached to the cleaning utensil. The deflector vane defines a deflector surface having a peripheral edge which is shaped to define two side lobes and a notch in a central portion thereof, providing a shape which is similar to that of a whale's tail. The deflector surface of the deflector vane has an edge profile which is of an arcuate shape, preferably a parabolic shape. Two ribs extend in parallel from a side of the deflector vane which is opposite the deflector surface. A brace is removably secured in different positions relative to the two ribs for selectively determining an angle between the handle and the deflector vane during downstrokes, to selectively control a level of force which the brush is pressed against a surface being cleaned, as the brush is moved through water.

DESCRIPTION OF THE DRAWINGS

For a more complete understanding of the present invention and the advantages thereof, reference is now made to the following description taken in conjunction with the accompanying Drawings in which

FIG. 1 is a perspective view of a cleaning tool made according to the present invention;

FIG. 2 is a side view of the cleaning tool;

FIG. 3 is an exploded, perspective view of a cleaning utensil assembly and handle of the cleaning tool;

FIG. 4 is a perspective view of a deflector vane of the cleaning tool;

FIG. 5 is a top view of the deflector vane;

FIG. 6 is a side view of the deflector vane;

FIG. 7 is a partial sectional view of the deflector vane, taken along section line 7-7 of FIG. 5;

FIG. 8 is a perspective view of a mounting bracket for securing the deflector vane to a brush;

FIG. 9 is a perspective view of an adjustable brace for providing a stop for the deflector vane;

FIG. 10 is a side view of the cleaning tool showing the adjustable brace in a second position, which is different from that of FIG. 2;

FIG. 11 is a side view of the cleaning tool in the position in which it would be disposed when moving upward within a body of water, showing the deflector vane angled forward with respect to a handle of the cleaning tool;

FIG. 12 is a perspective, exploded view of a portion of the cleaning utensil assembly, showing a mounting clip for securing the handle to the cleaning utensil assembly; and FIG. 13 is a partial cut away view showing the mounting clip within a mounting post of the cleaning utensil assembly.

DETAILED DESCRIPTION OF THE INVENTION

Figure 1:
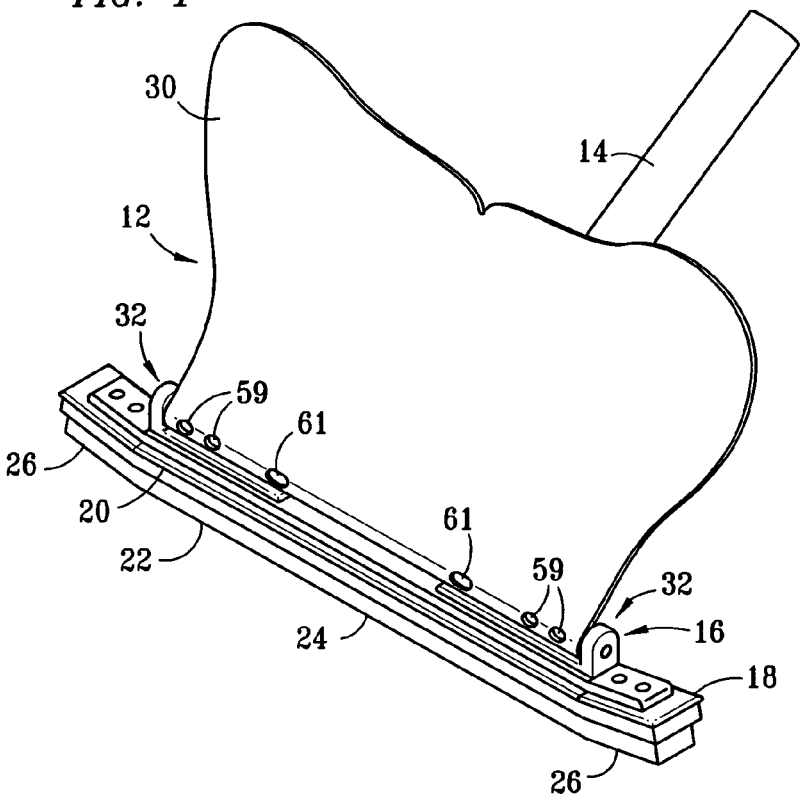
FIGS. 1 through 13 show various aspects for a pool brush with adjustable deflector vane made according to the present invention, as set forth below.

FIG. 1 is a perspective view of a cleaning tool 12, depicted as a pool brush. The cleaning tool 12 has a handle 14 and a cleaning utensil assembly 16. The cleaning utensil assembly 16 includes a brush 18 having a housing 20 and bristles 22. The bristles are preferably either wire bristles, or a plastic material, such as PVC, nylon or polypropylene, or a combination of the above. A central portion of the brush 18 is substantially planar, for fitting onto a planar surface for cleaning, and two end portions 26 are angled upward at approximately a twenty degree angle from the central portion 24, for fitting into edges and tight spaces. The cleaning utensil assembly 16 further includes a deflector vane 30, two mounting brackets 32, and an adjustable brace 34. (Shown in FIG. 2).

Figure 2:
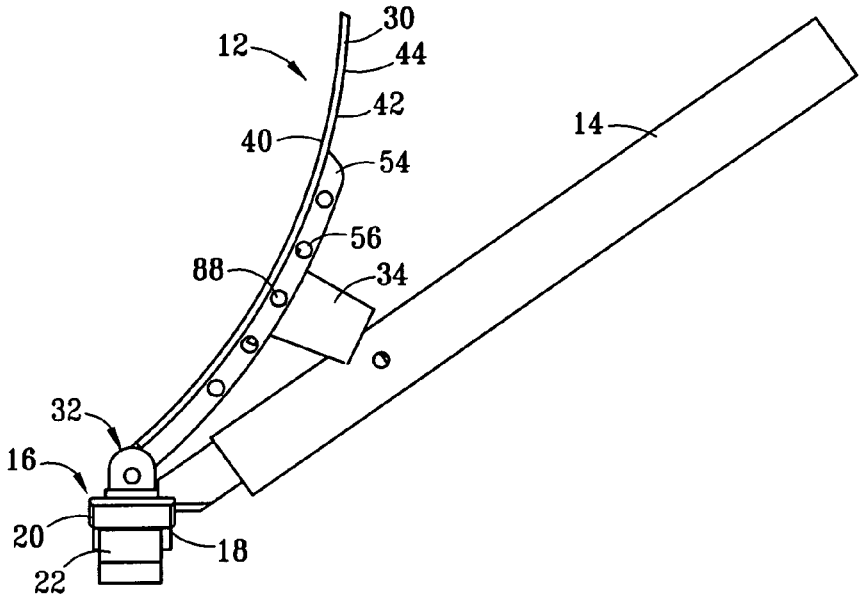

FIG. 2 is a side view of the cleaning tool 12. The two mounting brackets 32 are provided for pivotally securing the deflector vane 30 to the housing 20 of the brush 18. The adjustable brace 34 is moveable along the back side 42 of the deflector vane 30, in a direction which has a component that extends parallel to the longitudinal length of the handle 14.

Figure 3:
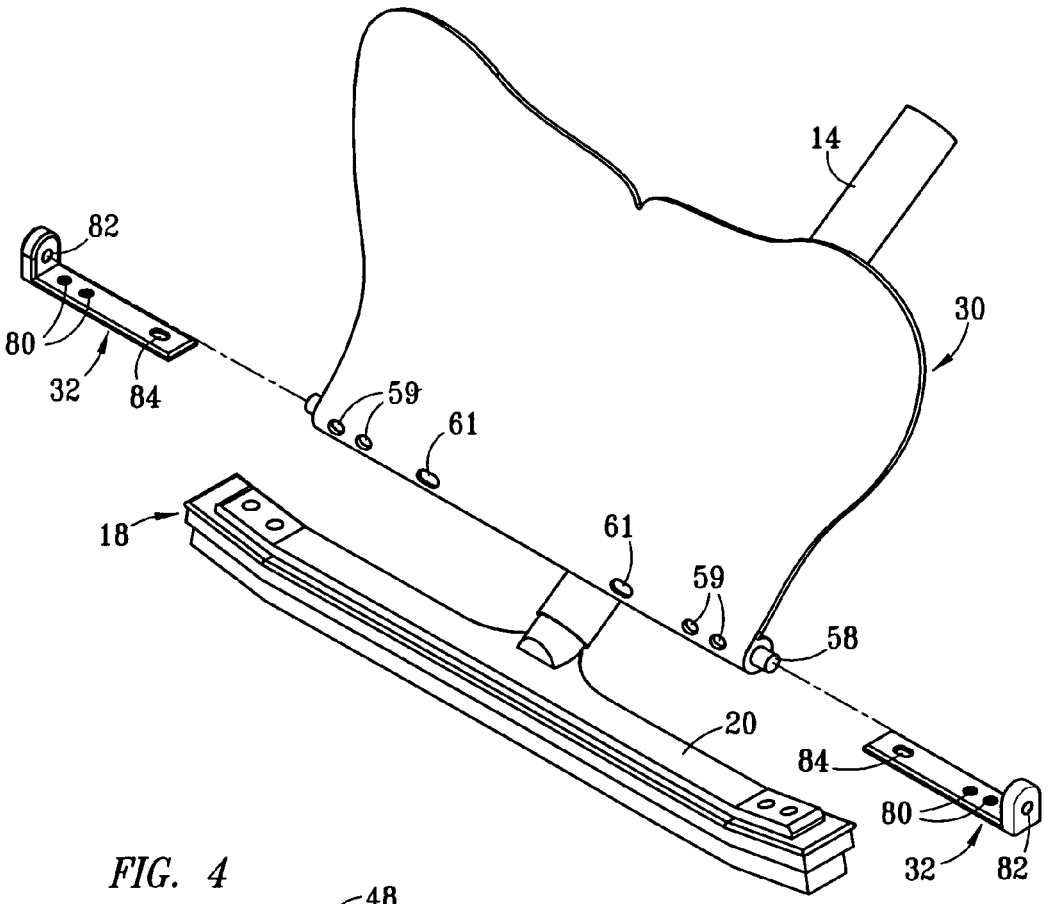

FIG. 3 is an exploded, perspective view of the cleaning utensil assembly 16 and the handle 14. The two mounting brackets 32 are shown having mounting holes 80 and slots 84 for receiving threaded fasteners which secure the mounting brackets 32 to the housing 20 of the brush 18. The mounting bracket 32 also has mounting holes 82 for receiving end tabs 58 of the deflector vane 30 to pivotally secure the deflector vane 30 to the brush 18.

Figure 4:
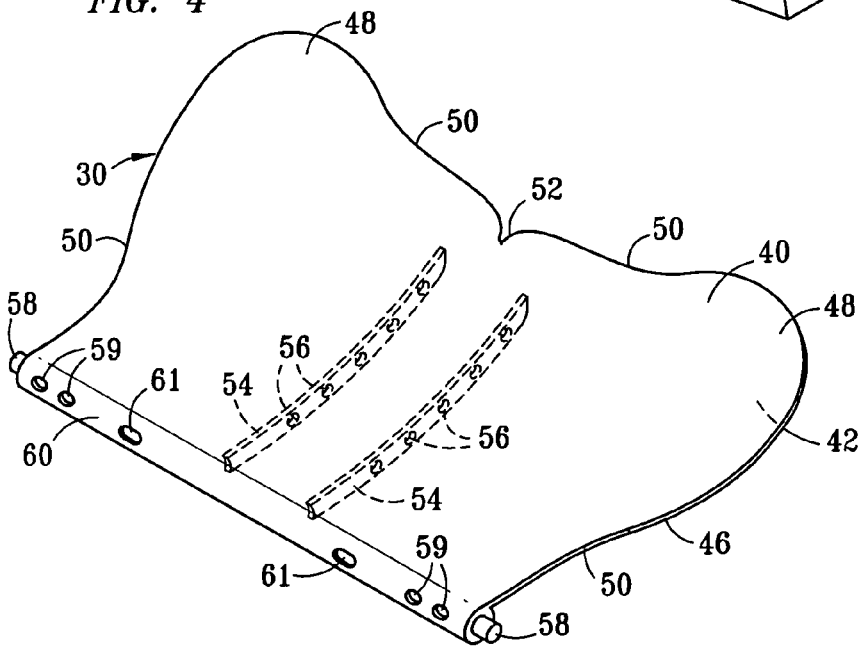

FIG. 4 is a perspective view of the deflector vane 30. Deflector vane 30 has a front side which provides a deflector surface 40, a back side 42 and an edge profile 44. (Shown in FIG. 2). The edge profile 44 is of arcuate shape, preferably being of a parabolic shape. The side 40 of the deflector vane 30 has a peripheral edge 46 defining an edge periphery which is also arcuately shaped, having a shape which is similar to a shape of a whale's tail. The peripheral edge 46 defines two side lobes 48. The deflector vane 30 has arcuately shaped surfaces 50. A rearward end, or trailing end, of the deflector vane 30 having a notch 52 disposed between two of the arcuately shaped surfaces 50. Ribs 54 extend in parallel on the back side 42 of the deflector vane 30, preferably extending in a direction which has a component that extends parallel to the handle 14, when the deflector vane 30 is disposed adjacent to the handle 14. The ribs 54 have mounting holes 56 which are provided for securing the adjustable brace 34 to the deflector vane 30. Mounting tabs 58 are provided on opposite sides of the forward end of the deflector vane 30, and fit within the mounting brackets 32 to pivotally secure the deflector vane 30 to the mounting brackets 32 and to the brush 18. The lower end 60 of the deflector vane 30 is preferably of cylindrical shape, being thicker than the main portion of the deflector vane 30 defined between the front side 40 and the back side 42, to provide a stronger structural member on the lower portion of the deflector vane 30 for pivotally securing to the mounting brackets 32 and the brush 18. Mounting holes 59 and slots 61 are provided in the lower portion 60 of the deflector vane 30, for accessing fasteners in the mountings holes 80 and the slots 84 in the mounting brackets 32. The mounting holes 80 and the slots 84 are configured for fitting standard hole patterns in a wide range of commercially available brushes.

Figure 5:
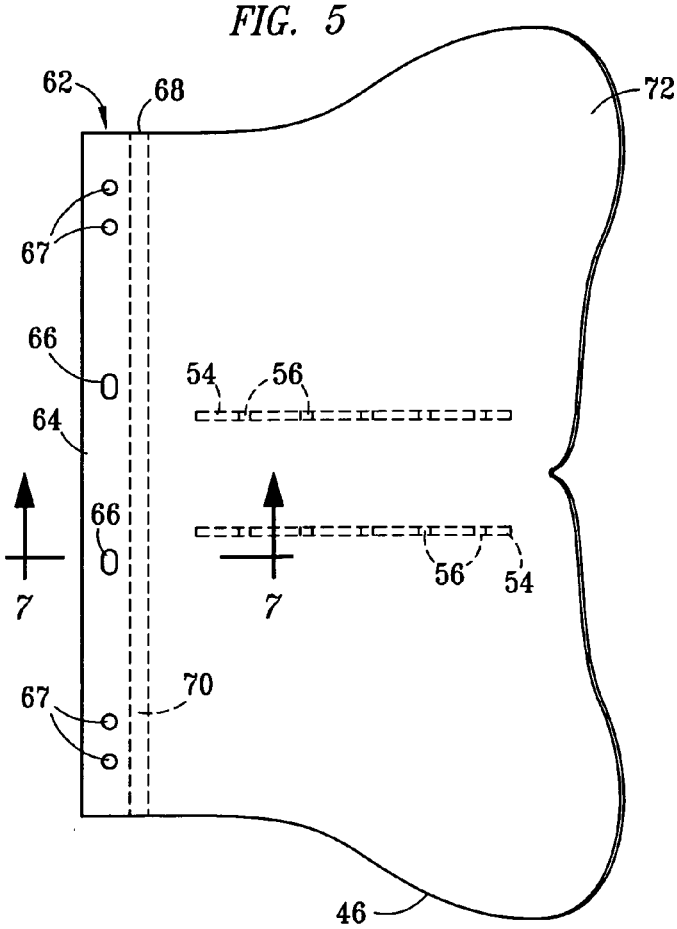
Figure 6:
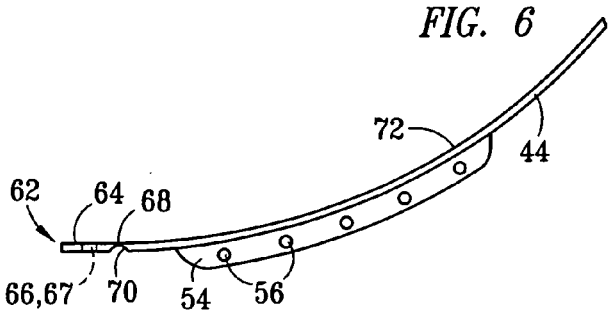
Figure 7:
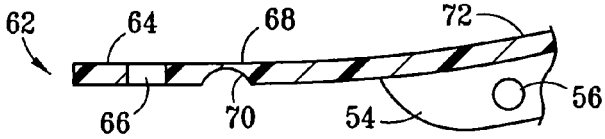

FIGS. 5, 6, and 7 are various views of a deflector vane 62 made according to an alternative embodiment of the present invention, with FIG. 5 being a top view of the deflector vane 62, FIG. 6 being a side view of the deflector vane 62, and FIG. 7 being a sectional view of the deflector vane 62, taken along section line 7-7 of FIG. 5. The deflector vane 62 has a mounting portion 64 with mounting holes 66, and a hinge section 68 having a living hinge defined by a notch 70. The notch 70 is formed into the hinge section 68 of the deflector vane 62, and preferably has a profile which is circular in shape. The notch 70 extends completely across the backside of the hinge section 68 of the deflector vane 72. Preferably, the deflector vane 62, as well as the deflector vane 30, is molded of plastic. The deflector vane 62 further includes the ribs 54 and an edge profile 44 and a peripheral edge 46, which are preferably similar to those of the deflector vane 30.

Figure 8:
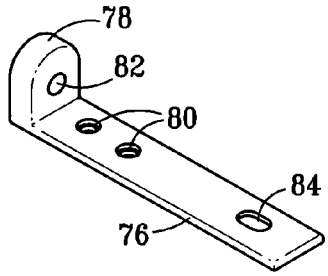

FIG. 8 is a perspective view of one of the mounting brackets 32. The mounting bracket 32 has a flange 76 and tab 78. The flange 76 has the mounting holes 80 and the slots 84 for receiving threaded fasteners for securing the mounting bracket 32 to the brush 18. (Shown in FIG. 1). The mounting holes 80 and the slots 84 may also be provided different configurations of holes and slots, for mounting to a wide variety of standard mounting hole configurations for cleaning utensils. The tab 78 has a mounting hole 82 for receiving the end tabs 58 of the deflector vane 30. (Shown in FIG. 4). The mounting brackets are preferably molded of plastic.

Figure 9:
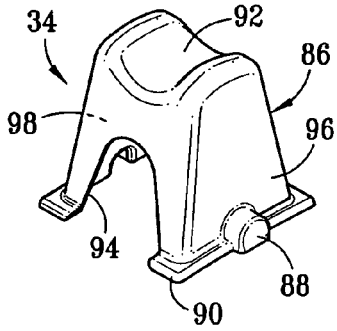

FIG. 9 is a perspective view of the adjustable brace 34. Preferably, the brace 34 is molded of plastic to provide a molded body 86 with a hollow interior. A lower end of the molded body 86 has two tabs 88 extending from opposite ends for fitting within opposed pairs of the holes 56 in the two parallel extending ribs 54 of the deflector vane 30. The lower end of the molded body 86 further includes a flanged end 92. The upper end of the molded body 86 includes a recess 92, providing an arcuately shaped surface for fitting against the exterior of the handle 14. (Shown in FIG. 2). Two U-shaped notches 94 are provided (one shown) on opposite sides of the molded body 86 such that the lower ends of the sides 96 and 98 of the molded body 86 may be pressed inward, such that the tabs 88 move towards one another for removing and for securing the tabs 88 within opposed pairs of the holes 56 of the two ribs 54. The sides 96 and 98 are disposed on opposite sides of the molded body 86, on opposite sides of the two U-shaped notches 94.

Figure 10:
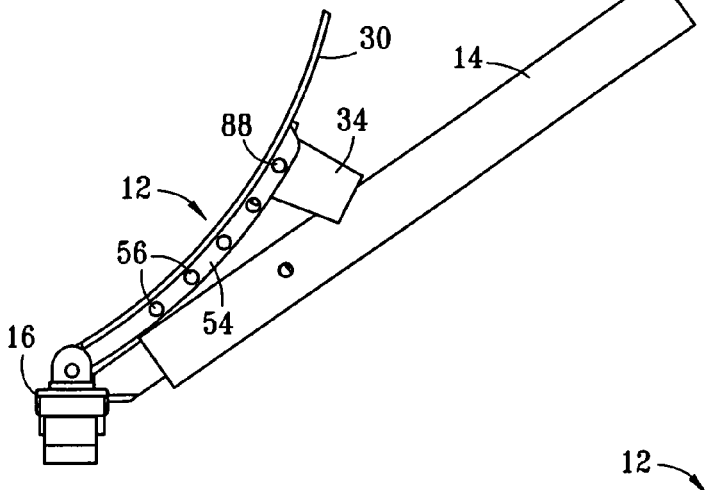

FIG. 10 is a side view of the cleaning tool 12, showing the adjustable brace 34 having been moved to a different position relative to the deflector vane 30 than the position shown in FIG. 2. The tabs 88 of the adjustable brace 34 are extending through the outward most pair of the opposed holes 56 of respective ones of the two parallel ribs 54, as opposed to being disposed in a central opposed pair of the holes 56 in the ribs 54, as shown in FIG. 2. With the mounting brace 34 disposed in the outward most pair of opposed holes 56 of the ribs 54, less force will be exerted by the deflector vane 30 pushing the brush 16 against the side of a pool, or other submerged surface being cleaned, for the same speed of the brush 16 moving through a fluid, or water, than the force exerted when the deflector vane 30 is in a more forward position, at a greater angle from the longitudinal length of the handle 14, as that shown in FIG. 2. That is, when the angle between the deflector vane 30 and the handle 14 is larger, as shown in FIG. 2, the water is deflected further outward, creating more force when the cleaning tool 12 is moved downward with the same velocity than when the angle between the deflector vane 30 and the handle 14 is smaller, as shown in FIG. 10. Thus, a user may desire to use less effort in pushing downward and prefer the position of the mounting brace 34 relative to the deflector vane 30 of FIG. 10. Other users may have a preference for more vigorous brushing, that is to apply a greater force to press the brush 18 against a submerged surface being cleaned. When greater force is desired, the adjustable brace 34 may be moved inward to the position shown in FIG. 2, or further forward in others of the opposed pairs of the opposed pairs of the holes 56 in the two parallel ribs 54.

Figure 11:
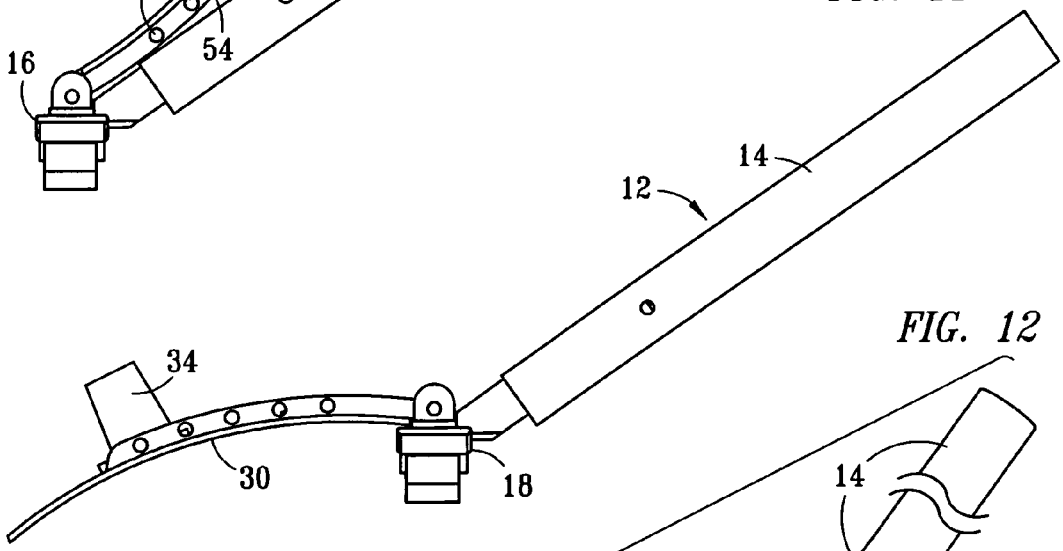

FIG. 11 is a side view of the cleaning tool 20, showing the deflector vane 30 in relative position to the handle 14 as it would be viewed while being pulled upward within the fluid, such that the deflector vane 30 has pivoted forward relative to the brush 18 and the handle 14. This will allow a user to pull the brush upward with less force, and without the brush being pushed against the surface being cleaned, but rather the brush 18 will fall away with the deflector vane 30 in the position shown. The deflector vane 30 is preferably shaped to provide a slight force, as compared to the forces exerted when moving downward, to push the brush 18 outward and away from the pool surface being cleaned.

Figure 12:
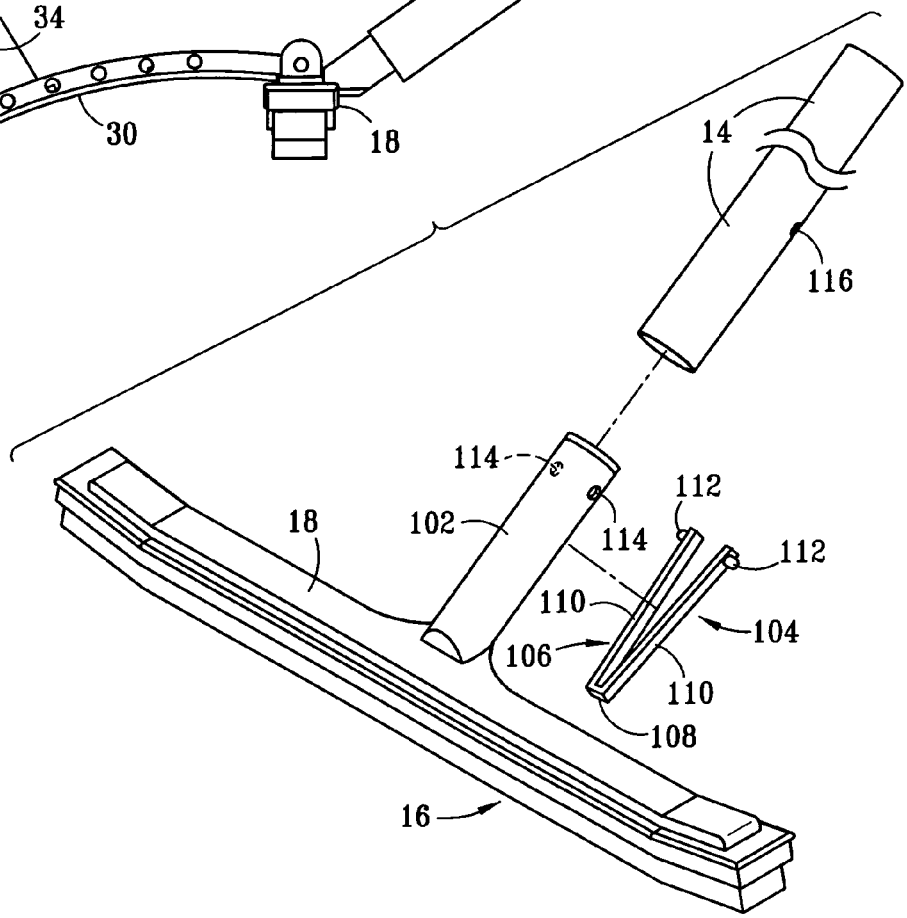

FIG. 12 is an exploded, perspective view of a portion of the assembly 16, the handle 14, and a mounting clip 104 for securing the handle 14 to the cleaning utensil assembly 16. The cleaning utensil assembly 16 has the brush 18 with a mounting post 102 extending rearward from the brush 18. The mounting clip 104 has a generally U-shaped body 106, having a central portion 108 and two leg portions 110. Two tabs 112 extend in opposite directions, outward from the outward planar ends of the leg portions 110. Holes 114 are provided in the outward end of the mounting post portion 102 of the cleaning assembly 16. The two holes 114 being disposed in opposed sides of the mounting post 102 for receiving respective ones of the two tabs 112 extending outward on opposite sides of the body 106 of the mounting clip 104. Preferably, the mounting clip 104 is inserted within the mounting post 102, such that the two tabs 112 will protrude outward from respective ones of the two holes 114. The handle 14 is preferably tubular and has two opposed holes 116 (one shown). The tubular body of the handle 14 will fit over the mounting post 102 until the holes 116 are aligned with the holes 114, and the tabs 112 of the mounting clip 104 protrude from holes 114 and extend into the holes 116 of the handle 14 to secure the handle 14 to the cleaning assembly 16. The mounting clip 104 is preferably molded of plastic, but the generally U-shaped body 106 provides a resilient force such that the two tabs 112 will extend outward through the holes 114 in the post 102 and through the holes 116 in handle 14.

Figure 13:
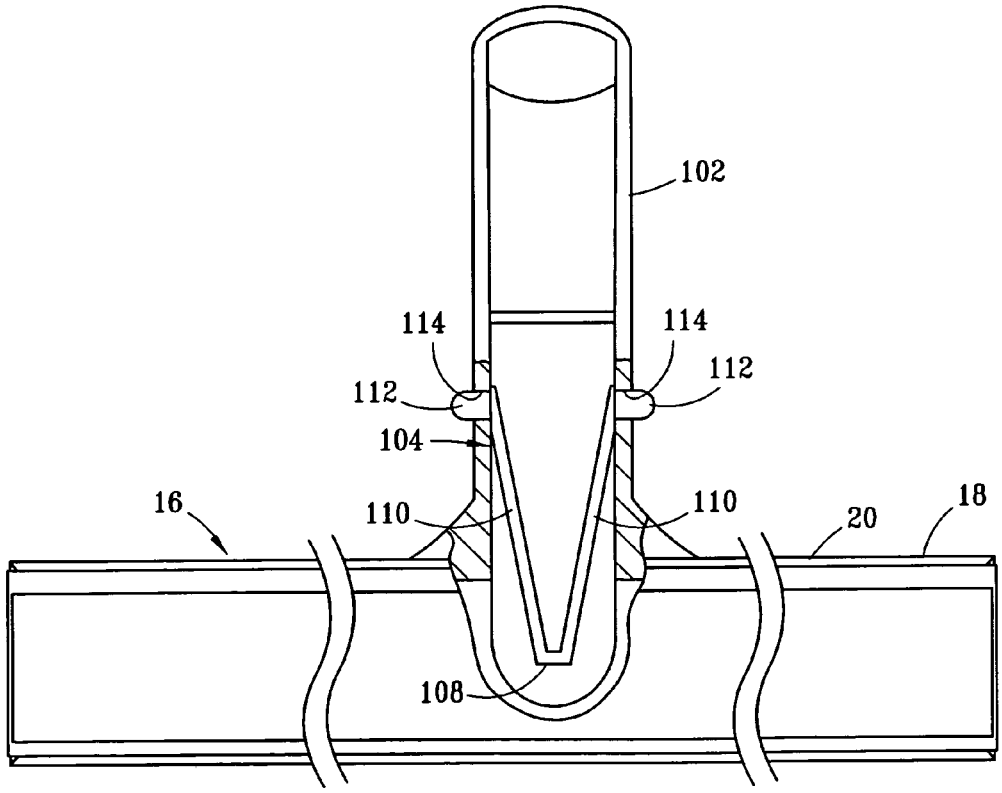

FIG. 13 is a partial cut away view of the cleaning assembly 16, showing the mounting clip 104 disposed within the mounting post 102 of the housing 20 of the brush 18. The two tabs 102 of the mounting clip 104 protrude through the holes 114 in the mounting post 102.

It should be noted that although the cleaning tool 12 is described as being a brush used to clean vertical surfaces, such as the side walls of a pool, and reference is made to downward movement creating a force to push the brush 18 against the surfaces being cleaned, other embodiments of the present invention may be configured for cleaning surfaces other than vertical surfaces. Additionally, the cleaning tool 12 may be configured such that upward movement creates force for pressing the cleaning utensil against a surface being cleaned, and downward movement pulls the cleaning utensil away from the surface being cleaned, as well as movement in other than downward or upward directions. It should also be noted that other types of cleaning utensils may be used with a deflector vane according to the present invention, such as a scraper, as well as other types of brushes than those shown in the accompanying drawings.

The present invention provides several advantages over prior art tools for cleaning submerged surfaces. The cleaning tool of the present invention has a deflector vane which is pivotally secured to a cleaning utensil, such as a brush, to provide hydrodynamic forces, such that during a downward stroke of the cleaning tool within a fluid, the fluid will engage against the deflector vane to push the cleaning tool inward and against a surface being cleaned. In an upward stroke, the deflector vane will pivot forward and the deflector vane will urge the cleaning tool away from the side wall surface being cleaned, such that debris will not be dragged upward against the surface being cleaned. An adjustable brace is provided which may be disposed in a plurality of positions to adjust the angle between the deflector vane and a handle secured to the cleaning utensil so that the force at which the cleaning utensil is pushed against the surface being cleaned may be adjusted for a various velocities of the cleaning utensil moving within the fluid. At higher forces, the cleaning utensil requires more downward force to move the cleaning utensil within the water, and at lower forces, a lower level of exertion is required by the user for cleaning a submerged surface. The level of force is readily adjustable, without requiring tools, by squeezing the adjustable brace to move the mounting tabs inward, and moving to different opposed holes in the ribs which extend in parallel on the backside of the deflector vane.

Although the preferred embodiment has been described in detail, it should be understood that various changes, substitutions and alterations can be made therein without departing from the spirit and scope of the invention as defined by the appended claims.

What is claimed is:

1. A cleaning tool for cleaning a surface submerged in a fluid, comprising:

a cleaning utensil having a housing and a handle;

a deflector vane having a first side which defines a deflector surface and a second side which extends on an opposite side of said deflector vane from said deflector surface, wherein said deflector vane is pivotally mounted to said housing of said cleaning utensil, such that said deflector vane will pivot from a first position to a second position relative to said housing in response to whether said cleaning tool is moving relative to a first direction and a second direction, respectively, within the fluid;

said deflector vane adapted such that when said deflector vane moves in said first direction along the submerged surface, said deflector surface pushes the fluid generally away from the submerged surface, which presses said cleaning utensil against the submerged surface;

an adjustment member adapted for selectively disposing relative to said deflector vane to determine said first position relative to said housing in which said deflector vane is disposed when said cleaning tool is traveling in the first direction within the fluid;

two ribs extending from said second side of said deflector vane, said two ribs having at least two pair of opposed holes in respective ones of said two ribs; and said adjustment member including a brace having two tabs which outwardly extend from opposite sides of said brace, wherein said two tabs of said brace are selectively disposed one of said two pair of opposed holes to selectively dispose said brace relative to said deflector vane.

2. The cleaning tool according to claim 1, wherein movement of said cleaning tool in the second direction, which is opposite the first direction, urges said cleaning tool to move away from the submerged surface.

3. A cleaning tool for cleaning a surface submerged in a fluid, comprising:

a cleaning utensil for moving in a first direction across the submerged surface to clean the surface;

deflector vane means having a deflector surface which when moved within the fluid in the first direction pushes the fluid in a direction which is transverse to said first direction;

means for pivotally securing said deflector vane means to said cleaning utensil, such that when said deflector surface is moved in the first direction along the submerged surface, said deflector surface moves in said first direction and pushes the fluid generally away from the submerged surface, which presses said cleaning utensil against the submerged surface;

adjustment means selectively disposing relative to said deflector vane means for selectively determining a relative angular position of said deflector surface to said cleaning utensil, to selectively determine a level of force at which said cleaning utensil is pressed against the submerged surface for a particular velocity at which said deflector surface is moving within the fluid;

said deflector vane means having a second side, which is opposite said deflector surface, said second side having two ribs which extend from said second side, and said two ribs having at least two pair of opposed holes in respective ones of said two ribs; and said adjustment means including a brace having two tabs which outwardly extend from opposite sides of said brace, wherein said two tabs of said brace are selectively disposed one of said two pair of opposed holes to selectively dispose said brace relative to said deflector vane means.

4. A cleaning tool for cleaning a surface submerged in a fluid, comprising:

a cleaning utensil having a housing and a handle;

a deflector vane having a front side, a back side and a peripheral edge, one end of said deflector vane pivotally mounted to said cleaning utensil, said deflector vane further having two ribs extending in parallel on a back side of said deflector vane, said two ribs having a plurality of mounting holes extending longitudinally along respective ones of said two ribs;

a brace having a body with two tabs which extend on opposite sides of said body, said body having at least one notch which extends into said body between said opposite sides of said body, such that said two opposite sides may be pressed in a direction towards one another to reduce a distance between said two tabs and said two tabs may be disposed in selective ones of said mounting holes of said two ribs, and said body of said brace further having one end thereof, between said opposite sides, for engaging said handle of said cleaning utensil; and wherein said deflector vane is pivotally secured to said cleaning utensil, such that movement of said cleaning utensil within the fluid in a first direction along the surface being cleaned urges said deflector vane to move toward said handle until said one end of said brace engages said handle and said front side of said deflector vane pushes the fluid in a transverse direction to said first direction and away from said handle and the surface being cleaned, which urges said cleaning utensil to move opposite said transverse direction and into the surface being cleaned.

5. The cleaning utensil according to claim 4, wherein movement of said cleaning utensil in a second direction within the fluid, which is opposite the first direction, urges said deflector vane to move away from said handle and trail said cleaning utensil and said handle within said fluid, which pushes the fluid in a direction which is generally opposite said transverse direction and urges said cleaning utensil to move away from the surface being cleaned.

6. The cleaning utensil according to claim 4, further comprising:

said deflector vane further having two end tabs which extend from opposite portions of said peripheral edge of said deflector vane; and two mountings brackets each having a mounting aperture for pivotally receiving respective ones of said end tabs of said deflector vane to pivotally secure said deflector vane to said cleaning utensil, and said two mounting brackets further having apertures for securing said two mounting brackets to said cleaning utensil.

7. The cleaning utensil according to claim 4, wherein said deflector vane includes a mounting portion and a hinge section, said hinge section having a notch which extends across one of said front side and said back side of said deflector to define a living hinge within said hinge section.

8. The cleaning tool according to claim 4, wherein said peripheral edge of said deflector vane has a generally arcuate shape, which define two lobes and a notch on a rearward edge of said deflector vane to provide said front side and back side of said deflector vane with a shape resembling a whale's tail.

9. The cleaning tool according to claim 4, wherein said deflector vane has a profile of a generally parabolic shape.

10. A cleaning tool for cleaning a surface submerged in a fluid, comprising:

a cleaning utensil having a housing and a handle;

a deflector vane having a front side, a back side and a peripheral edge, one end of said deflector vane having two end tabs which extend from opposite portions of said peripheral edge of said deflector vane, and said deflector vane further having two ribs extending in parallel on a back side of said deflector vane, said two ribs having a plurality of mounting holes extending longitudinally along respective ones of said two ribs;

a brace having a body with a hollow interior and two tabs which extend on opposite sides of said body, said body having two notches which extend into said body between said opposite sides of said body, such that said two opposite sides may be pressed in a direction towards one another to reduce a distance between said two tabs and said two tabs may be disposed in selective ones of said mounting holes of said two ribs, and said body of said brace further having a recess formed in one end thereof, between said opposite sides, for engaging said handle of said cleaning utensil;

two mounting brackets each having a mounting aperture for pivotally receiving respective ones of said end tabs of said deflector vane to pivotally secure said deflector vane to said cleaning utensil, and said two mounting brackets further having apertures for securing said two mounting brackets to said cleaning utensil; and wherein said deflector vane is pivotally secured to said cleaning utensil, such that movement of said cleaning utensil within the fluid in a first direction along the surface being cleaned urges said deflector vane to move toward said handle until said recess of said brace engages said handle and said front side of said deflector vane pushes the fluid in transverse direction to said first direction, and away from said handle and the surface being cleaned, which urges said cleaning utensil to press against the surface being cleaned, and movement of said cleaning utensil in a second direction within the fluid, which is opposite said first direction, urges said deflector vane to move away from said handle and trail said cleaning utensil and said handle within said fluid, which pushes the fluid in a direction which is generally opposite said transverse direction and urges said cleaning utensil to move away from the surface being cleaned.

11. The cleaning tool according to claim 10, wherein said peripheral edge of said deflector vane has a generally arcuate shape, which define two lobes and a notch on a rearward edge of said deflector vane to provide said front side and back side of said deflector vane with a shape resembling a whale's tail.

12. The cleaning tool according to claim 11, wherein said deflector vane has a profile of a generally parabolic shape.

13. The cleaning tool according to claim 12, wherein said cleaning utensil comprises a brush.

* * * * *